US011808130B1

(12) United States Patent
Provost

(10) Patent No.: US 11,808,130 B1
(45) Date of Patent: Nov. 7, 2023

(54) ACTUATOR, METHOD AND SYSTEM

(71) Applicant: Wilfred Provost, Tomball, TX (US)

(72) Inventor: Wilfred Provost, Tomball, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/841,762

(22) Filed: Jun. 16, 2022

(51) Int. Cl.
*E21B 34/14* (2006.01)
*E21B 43/38* (2006.01)
*E21B 21/08* (2006.01)

(52) U.S. Cl.
CPC ..... *E21B 43/38* (2013.01); *E21B 21/08* (2013.01); *E21B 34/14* (2013.01)

(58) Field of Classification Search
CPC ..... E21B 34/14
See application file for complete search history.

(56) References Cited

U.S. PATENT DOCUMENTS 5,058,674 A * 10/1991 Schultz ..... E21B 49/082 166/264
8,322,426 B2 * 12/2012 Wright ..... E21B 23/06 166/376
8,429,961 B2 * 4/2013 Irani ..... E21B 49/081 73/152.23
8,813,857 B2 * 8/2014 Mills ..... E21B 23/04 166/387
2012/0043092 A1 * 2/2012 Arizmendi, Jr. ..... E21B 41/00 166/330
2022/0195842 A1 * 6/2022 Werkheiser ..... E21B 23/04

* cited by examiner

*Primary Examiner* — Matthew R Buck
(74) *Attorney, Agent, or Firm* — CANTOR COLBURN LLP

(57) ABSTRACT

An actuator including a housing defining a volume changeable chamber therein, the volume changeable chamber being divided into a first volume changeable subchamber, a second volume changeable subchamber, a separator disposed between the first volume changeable subchamber and the second volume changeable subchamber, the separator initially preventing mixing of substances in the first volume changeable subchamber and in the second volume changeable subchamber and at a selected time allowing fluid movement between the first and second volume changeable subchamber. A method for actuating a tool including triggering a separator between a first volume changeable subchamber having a first substance therein and a second volume changeable subchamber having a second substance therein within a housing containing the first volume changeable subchamber and the second volume changeable subchamber. A borehole system including a borehole in a subsurface formation, and an actuator disposed in the borehole.

20 Claims, 4 Drawing Sheets

ACTUATOR, METHOD AND SYSTEM

BACKGROUND

In the resource recovery industry and fluid sequestration industries there is often need for actuation of devices in a downhole environment. Many different types of actuators have been used and continue to be used. Some that rely upon pressure differentials work admirably but also require structural considerations due to the pressure differential experienced while in the borehole. The art is rewarded by the improvement in efficiencies and hence will welcome alternative constructions.

SUMMARY

An embodiment of an actuator including a housing defining a volume changeable chamber therein, the volume changeable chamber being divided into a first volume changeable subchamber, a second volume changeable subchamber, a separator disposed between the first volume changeable subchamber and the second volume changeable subchamber, the separator initially preventing mixing of substances in the first volume changeable subchamber and in the second volume changeable subchamber and at a selected time allowing fluid movement between the first and second volume changeable subchamber.

An embodiment of a method for actuating a tool including triggering a separator between a first volume changeable subchamber having a first substance therein and a second volume changeable subchamber having a second substance therein within a housing containing the first volume changeable subchamber and the second volume changeable subchamber, the first substance and second substance being mixable to create a volume that is less than a volume of the first substance plus the volume of the second substance, comingling the first substance and the second substance, harnessing a hydraulic differential across the housing caused by the reduction of total substance volume in the first and second volume changeable subchambers.

An embodiment of a borehole system including a borehole in a subsurface formation, and an actuator disposed in the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
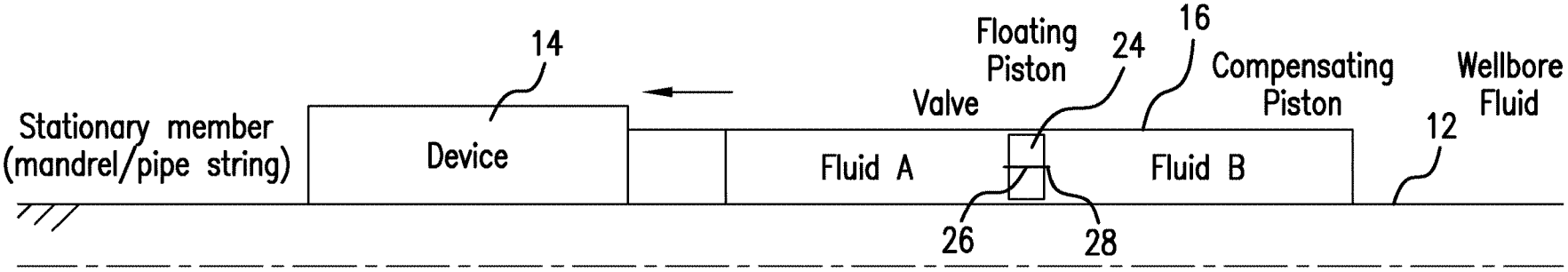
FIG. 1 is a schematic view of an actuator as disclosed herein disposed upon a borehole mandrel.

Referring to FIG. 1, an actuator 10 is illustrated schematically on a mandrel 12 and in operative communication with a device 14 that is to be actuated. Mandrel 12 may be a part of a string (see FIG. 3). Device 14 may be any kind of device that is actuated by a process that includes the movement of a driver 15. Devices 14 include but are not limited to packers, plugs, barrier valves (ball valves, sliding sleeves, etc.), Fluid loss Control Valves, setting tools, etc. Actuator 10 comprises a housing 16 that defines a volume changeable chamber 18. The chamber 18 is divided into a first volume changeable subchamber 20 and a second volume changeable subchamber 22 (note that additional divisions are also contemplated such that there is no limitation to only a first and second subchamber). A separator 24 is disposed in the chamber 18 between the first volume changeable subchamber 20 and the second volume changeable subchamber 22. The separator is configured to allow or not allow a substance from the first subchamber 20 to contact a substance from the second subchamber 22. In embodiments, the substance may be a liquid or a gas or a solid. In some cases the solid substance is in a particulate form so that a fluid movement of the solid is enabled. The separator may thus be or include a valve. This may be accomplished through the separator 24 having an orifice 26 therein that is selectively openable. The separator 24 may also be movable relative to the housing 16, in some embodiments, such that the physical structural volume of the first subchamber 20 and second subchamber 22 may be adjusted by position of the separator 24, which in turn will enhance mixing of the substances contained in the two chambers, during use. This may be particularly true in the case where the substances are fluids (liquids or gasses). Orifice 26 is openable mechanically, electrically, hydraulically, or by degradation of a part of the separator 24, such as a plug in the orifice 26. A degradable plug 28 may comprise a controlled electrolytic metallic material that is sensitive to one or both of the first and second substances and degrades over a known time period. In each case, the separator 24 initially is a barrier to mixing and after activation permits mixing. In embodiments where the separator 24 is moved as well as opened, the result will be a jetting of substance from the subchamber into which the separator 24 is moved toward (and into) the subchamber away from which the separator 24 moved. This feature is more effective if the substance is a fluid. Jetting of fluid through the orifice or orifices 26 enhances mixing of the first and second substances. In an embodiment, the separator 24 will move all the way to an opposite end of the subchamber into which the separator is moved to ensure a jetting of all of the substance previously segregated into that subchamber. It should be understood however that the separator 24 need merely be opened for the substances to begin mixing. It would simply take some time before sufficient mixing occurred that actuation could begin.

The actuator 10 develops a force with which to actuate another device 14 by causing a differential pressure to exist across housing 16. This occurs by selecting substances for the first subchamber and the second subchamber that when mixed with each other, produce a volume of higher density that naturally also has a lower volume. Alcohol (e.g. ethanol) and water are one example of two fluids that can be mixed in this way because the alcohol molecule is small enough to slide into interstitial spaces in between liquid water molecules. For example, 50 ml (milliliters) water and 50 ml alcohol when mixed together produce about % ml of the mixture. The lower volume of substance now within the chamber 18 means that the pressure outside of the chamber 18 that was balanced before mixing becomes overbalanced and will squeeze the structural dimensions of the chamber 18. Since the housing is built to respond to such overpressure in the surrounding environment by allowing its structural volume to be changed (like one portion of the housing can slide relative to another changing the internal structural dimensions of the chamber 18, energy is harvested in the reaction. In one embodiment of using this harvested energy, the housing 16 is connected to the driver 15 and hence causes the driver 15 to move when the structural volume changes. That movement is used to actuate the device 14.

Figure 2:
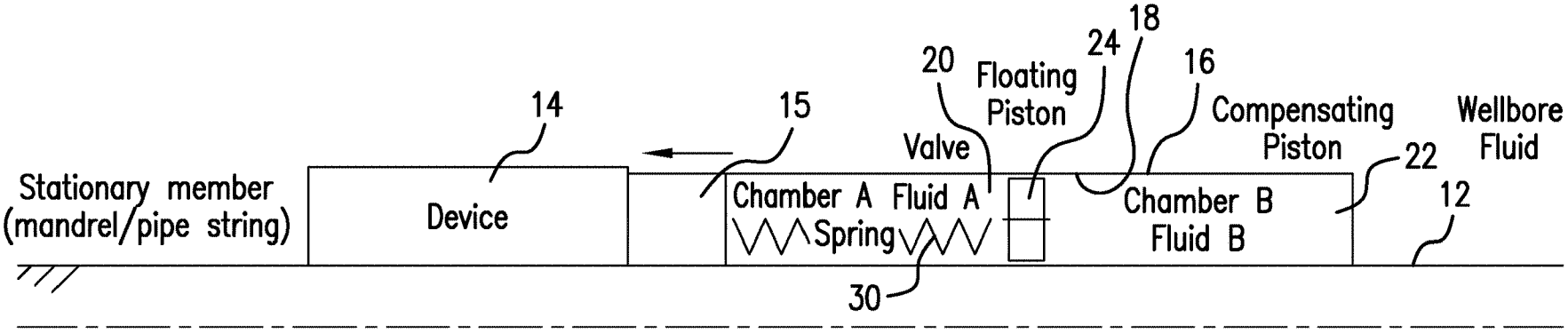
FIG. 2 is an alternate schematic view of an actuator as disclosed herein disposed upon a borehole mandrel.

Referring to FIG. 2, an alternate embodiment of actuator 10 includes a biaser 30 that is configured to move the separator 24. The biaser 30 may be a resilient material such as a coiled spring or similar or may be a compressed gas chamber, etc. In any event, the biaser 30 tends to force separator 24 into one of the subchambers thus enhancing and speeding the mixing operation. It will be appreciated that biaser 30 cannot move the separator 24 before the orifice 26 is open.

Figure 3:
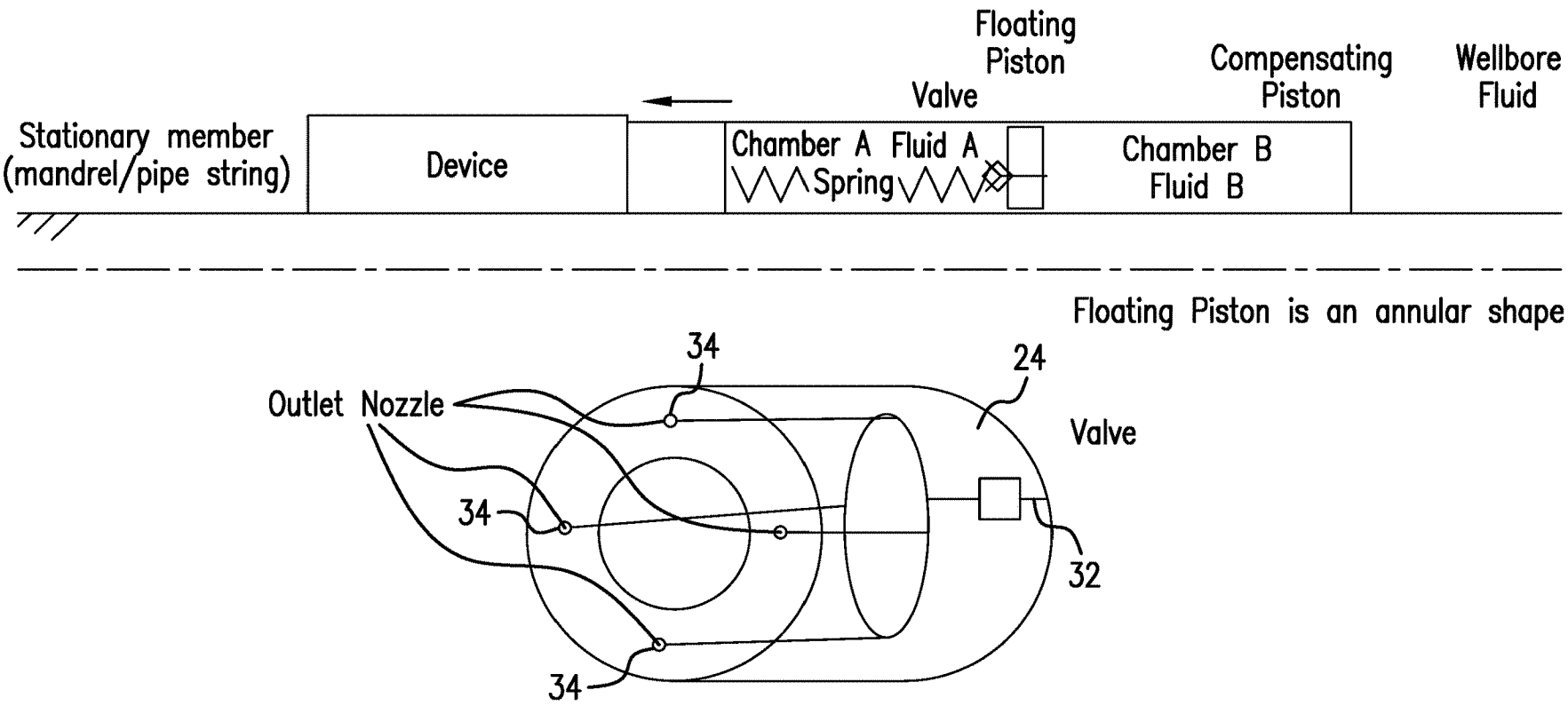
FIG. 3 is a schematic view of a separator portion of the actuator illustrating one construction thereof.

Referring to FIG. 3, another embodiment of separator 24 is illustrated. This embodiment uses an inlet 32 fluidly connected to multiple outlets 34 that cause substance to spread out and mix more thoroughly. The outlets 34 may also be angled to create a spinning action of substance jetting therefrom (particularly useful when the substance is a fluid) again for the purpose of enhanced mixing.

It is also to be appreciated that the chamber 18 may be annular in nature or may only be part annular in nature with the same effect. It also should be appreciated that the actuation force generated can be adjusted either by adjusting the volume of fluids used, with a larger volume of fluid creating a larger change in volume or could be adjusted by using different fluid pairs that allow for greater volumetric change in chamber 18. The greater the volumetric change obtainable in chamber 18 the greater the environmental hydrostatic differential and therefore the greater the force generated by the actuator.

Substances contemplated include water and ethanol, ethylene glycol, propylene glycol and magnesium sulfate (as a particulate in an embodiment).

Figure 4:
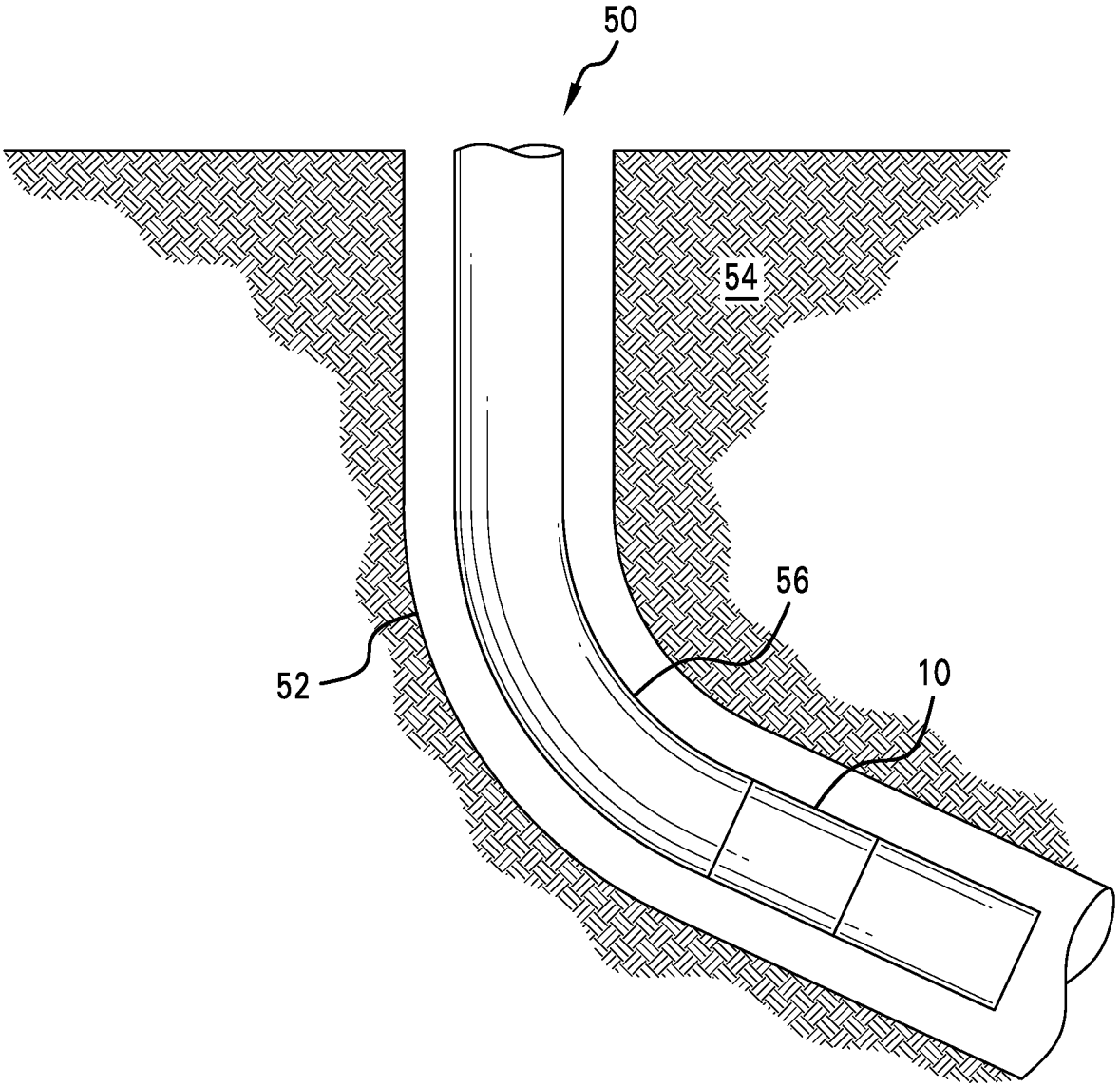
FIG. 4 is a view of a borehole system including the actuator as disclosed herein.

Referring to FIG. 4, a borehole system 50 is illustrated. The system 50 comprises a borehole 52 in a subsurface formation 54. A string 56 is disposed within the borehole 52. And the actuator 10 as disclosed herein is disposed within or as a part of the string 56.

Set Forth Below are Some Embodiments of the Foregoing Disclosure:

Embodiment 1: An actuator including a housing defining a volume changeable chamber therein, the volume changeable chamber being divided into a first volume changeable subchamber, a second volume changeable subchamber, a separator disposed between the first volume changeable subchamber and the second volume changeable subchamber, the separator initially preventing mixing of substances in the first volume changeable subchamber and in the second volume changeable subchamber and at a selected time allowing fluid movement between the first and second volume changeable subchamber.

Embodiment 2: The actuator as in any prior embodiment, wherein the volume changeable chamber is pressure balanced against an environment outside of the housing.

Embodiment 3: The actuator as in any prior embodiment, wherein the separator is in operative contact with a biaser.

Embodiment 4: The actuator as in any prior embodiment, wherein the biaser is a gas, or a resilient material or configuration.

Embodiment 5: The actuator as in any prior embodiment, wherein the separator is mobile within the volume changeable chamber such that the separator is movable to change the volumes of the two volume changeable subchambers.

Embodiment 6: The actuator as in any prior embodiment, wherein the separator selectively allows a substance to flow through itself.

Embodiment 7: The actuator as in any prior embodiment, wherein the separator includes a selectively openable orifice therethrough.

Embodiment 8: The actuator as in any prior embodiment, wherein the selectively openable orifice is a plurality of selectively openable orifices.

Embodiment 9: The actuator as in any prior embodiment, wherein the separator further actively causes a mixing of the substance in the first volume changeable subchamber and the substance in the second volume changeable subchamber.

Embodiment 10: The actuator as in any prior embodiment, wherein the separator causes jetting of the substance contained in one of the first subchamber or second subchamber into which the separator is moved into the other of the first subchamber or second subchamber.

Embodiment 11: The actuator as in any prior embodiment, wherein the separator comprises a degradable material.

Embodiment 12: The actuator as in any prior embodiment, wherein the separator degrades over a known time after exposure to the substance in one of the first volume changeable subchamber, or the second volume changeable subchamber, or both.

Embodiment 13: The actuator as in any prior embodiment, wherein the separator is a valve.

Embodiment 14: The actuator as in any prior embodiment, wherein at least one of the substances is a solid.

Embodiment 15: The actuator as in any prior embodiment, wherein the substances are a first fluid in the first volume changeable subchamber and a second fluid in the second volume changeable subchamber, the first and second fluids being miscible to create a volume that is less than a volume of the first fluid plus the volume of the second fluid.

Embodiment 16: A method for actuating a tool including triggering a separator between a first volume changeable subchamber having a first substance therein and a second volume changeable subchamber having a second substance therein within a housing containing the first volume changeable subchamber and the second volume changeable subchamber, the first substance and second substance being mixable to create a volume that is less than a volume of the first substance plus the volume of the second substance, comingling the first substance and the second substance, harnessing a hydraulic differential across the housing caused by the reduction of total substance volume in the first and second volume changeable subchambers.

Embodiment 17: The method as in any prior embodiment wherein the triggering is mechanical, electrical or hydraulic.

Embodiment 18: The method as in any prior embodiment wherein the commingling is by moving the separator to change a physical volume of the first volume changeable subchamber, or the second volume changeable subchamber, or both and causing displacement of one of the first substance and the second substance relative to the other of the first substance and the second substance due to the movement.

Embodiment 19: The method as in any prior embodiment wherein the substance is a fluid and the displacing of the fluid is jetting of the fluid.

Embodiment 20: A borehole system including a borehole in a subsurface formation, and an actuator as in any prior embodiment disposed in the borehole.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An actuator comprising:

a housing defining a volume changeable chamber therein, the volume changeable chamber being divided into:

a first volume changeable subchamber;

a second volume changeable subchamber;

a separator disposed between the first volume changeable subchamber and the second volume changeable subchamber, the separator initially preventing mixing of substances in the first volume changeable subchamber and in the second volume changeable subchambers and at a selected time allowing fluid movement between the first and second volume changeable subchamber wherein the substances are a first fluid in the first volume changeable subchamber and a second fluid in the second volume changeable subchamber, the first and second fluids being miscible to create a volume that is less than a volume of the first fluid plus a volume of the second fluid.

2. The actuator as claimed in claim 1, wherein the volume changeable chamber is pressure balanced against an environment outside of the housing.

3. The actuator as claimed in claim 1, wherein the separator is in operative contact with a biaser.

4. The actuator as claimed in claim 3, wherein the biaser is a gas, or a resilient material or configuration.

5. The actuator as claimed in claim 1, wherein the separator is mobile within the volume changeable chamber such that the separator is movable to change the volumes of the first and second volume changeable subchambers.

6. The actuator as claimed in claim 1, wherein the separator selectively allows a substance to flow through itself.

7. The actuator as claimed in claim 1, wherein the separator includes a selectively openable orifice therethrough.

8. The actuator as claimed in claim 7, wherein the selectively openable orifice is a plurality of selectively openable orifices.

9. The actuator as claimed in claim 1, wherein the separator further actively causes a mixing of the substance in the first volume changeable subchamber and the substance in the second volume changeable subchamber.

10. The actuator as claimed in claim 1, wherein the separator causes jetting of the substance contained in one of the first subchamber or the second subchamber into which the separator is moved into the other of the first subchamber or the second subchamber.

11. The actuator as claimed in claim 1, wherein the separator comprises a degradable material.

12. The actuator as claimed in claim 11, wherein the separator degrades over a known time after exposure to the substance in one of the first volume changeable subchamber, or the second volume changeable subchamber, or both.

13. The actuator as claimed in claim 1, wherein the separator is a valve.

14. The actuator as claimed in claim 1, wherein at least one of the substances is a solid.

15. A borehole system comprising:

a borehole in a subsurface formation; and an actuator as claimed in claim 1 disposed in the borehole.

16. A method for actuating a tool comprising:

triggering a separator between a first volume changeable subchamber having a first substance therein and a second volume changeable subchamber having a second substance therein within a housing containing the first volume changeable subchamber and the second volume changeable subchamber, the first substance and the second substance being mixable to create a volume that is less than a volume of the first substance plus a volume of the second substance;

comingling the first substance and the second substance;

harnessing a hydraulic differential across the housing caused by the reduction of total substance volume in the first and second volume changeable subchambers.

17. The method as claimed in claim 16 wherein the triggering is mechanical, electrical or hydraulic.

18. The method as claimed in claim 16 wherein the commingling is by moving the separator to change a physical volume of the first volume changeable subchamber, or the second volume changeable subchamber, or both and causing displacement of one of the first substance and the second substance relative to the other of the first substance and the second substance due to the movement.

19. The method as claimed in claim 18 wherein the substance is a fluid and the displacing of the fluid is jetting of the fluid.

20. An actuator comprising:

a housing defining a volume changeable chamber therein, the volume changeable chamber being divided into:

a first volume changeable subchamber;

a second volume changeable subchamber;

a separator disposed between the first volume changeable subchamber and the second volume changeable subchamber, the separator initially preventing mixing of substances in the first volume changeable subchamber and in the second volume changeable subchambers and at a selected time allowing fluid movement between the first and second volume changeable subchamber, wherein the separator causes jetting of the substance contained in one of the first subchamber or the second subchamber into which the separator is moved into the other of the first subchamber or the second subchamber.

* * * * *